US006032583A

United States Patent [19]

Karlstedt et al.

[11] Patent Number: 6,032,583

[45] Date of Patent: Mar. 7, 2000

[54] AMMUNITION UNIT IN THE FORM OF A SHELL

[75] Inventors: Gustav Karlstedt; Jyrki Helander; Lennart Sjöö; Miroslaw Benendo; Pär Andersson; Richard Lindvall, all of Eskilstuna, Sweden

[73] Assignee: Bofors AB, Karlskoga, Sweden

[21] Appl. No.: 09/125,948

[22] PCT Filed: Mar. 20, 1997

[86] PCT No.: PCT/SE97/00460

§ 371 Date: Oct. 19, 1998

§ 102(e) Date: Oct. 19, 1998

[87] PCT Pub. No.: WO97/35157

PCT Pub. Date: Sep. 25, 1997

[30] Foreign Application Priority Data

Mar. 22, 1996 [SE] Sweden ..... 9601114

[51] Int. Cl.[7] ..... F42B 12/18; F42B 12/20

[52] U.S. Cl. ..... 102/476; 102/308; 102/378; 102/478

[58] Field of Search ..... 102/308, 378, 102/473, 476, 478

[56] References Cited

U.S. PATENT DOCUMENTS

| | | | |
|---|---|---|---|
| 4,497,253 | 2/1985 | Sabranski | 102/476 |
| 4,606,272 | 8/1986 | Kerdraon | 102/308 |
| 4,612,859 | 9/1986 | Furch et al. | 102/476 |
| 4,854,240 | 8/1989 | Hirsch et al. | 102/476 |
| 5,107,766 | 4/1992 | Schliesske et al. | 102/478 |
| 5,698,814 | 12/1997 | Parsons et al. | 102/478 |

FOREIGN PATENT DOCUMENTS

| | | | |
|---|---|---|---|
| 0 238 715 A1 | 9/1987 | European Pat. Off. . | |
| 493294 | 8/1919 | France | 102/478 |
| 2385074 | 11/1978 | France | 102/476 |
| 2552870 | 4/1985 | France | 102/476 |
| 36 05 580 C1 | 6/1987 | Germany . | |
| 1051407 | 12/1966 | United Kingdom | 102/476 |
| 2272962 | 6/1994 | United Kingdom | 102/308 |

*Primary Examiner*—Harold J. Tudor
*Attorney, Agent, or Firm*—Pollock, Vande Sande & Amernick

[57] ABSTRACT

The present invention relates to an ammunition unit in the form of a shell or the like, with at least two warheads connected via a supporting structure. In order to prevent the impact from the first activated warhead reaching the warheads situated to the rear, and to prevent an interference effect on these warheads, according to the invention a structure-dividing charge is arranged in the supporting structure in order to divide the structure into two separate parts.

8 Claims, 2 Drawing Sheets

AMMUNITION UNIT IN THE FORM OF A SHELL

FIELD OF THE INVENTION

The present invention relates to an ammunition unit in the form of a shell or the like, comprising at least one front warhead and one rear warhead, such as, for example, shaped-charge warheads, arranged in succession one after the other and connected to each other via a supporting structure. Each of the warheads included is assigned an ignition device with ignition and safety functions, and the ignition device of the front warhead is arranged in the supporting structure behind the front warhead in the direction of action of a warhead lying to the rear.

BACKGROUND OF THE INVENTION

An ammunition unit of the above type is already known from EP, B1, 0 238 715, for example. The latter involves a small front warhead with shaped charge, the so-called pre-penetrator, and a larger rear warhead with shaped charge, the so-called main charge.

In ammunition units of this known type, there are a number of factors which can radically impair the efficiency of the ammunition unit. One such factor is the impact which the first activated warhead generates and which propagates through to the remaining and not yet activated warheads. The impact can damage warheads situated to the rear or disrupt them so that they do not interact with the first warhead in the intended manner. The impact problem is aggravated especially when the front warhead is made larger. Another factor impairing efficiency is the disruptive influence which the ignition device of the front warhead has on a shaped-charge jet coming from the rear.

SUMMARY OF THE INVENTION

The object of the present invention is to lessen or to completely prevent the impairment in the efficiency of the ammunition unit caused by the above factors mentioned. The object of the invention is achieved by means of an ammunition unit in which structure-dividing charge is arranged in the supporting structure in order to divide the supporting structure into a front part and a rear part after initiation. In this context, division of the structure is intended to mean everything from narrow cuts to more extensive removal of material in the area where the supporting structure is divided. By dividing the structure, the impact from the front warhead is prevented from reaching warheads situated to the rear. At the same time, parts of the ignition device are also exposed.

According to one advantageous embodiment, the structure-dividing charge comprises an annular element with an external diameter essentially corresponding to the internal diameter of the supporting structure, and a number of radial channels which connect the inner surface of the annular element to a central point common to the channels. This embodiment of the structure-dividing charge has been shown to produce an effective division of the structure without any disruptive effect on the rest of the ammunition unit. According to a specific embodiment based on this annular design, the annular element is connected to the common center point by means of two channels directed radially towards each other. This embodiment gives a symmetrical activation with little effect on warheads situated to the rear.

According to another advantageous embodiment, the structure-dividing charge comprises a disc-shaped element whose external diameter essentially corresponds to the internal diameter of the supporting structure. A structure-dividing charge of this design is, among other things, simple to produce.

For improving the efficiency of the ammunition unit still further, according to yet another advantageous embodiment, a clearing charge can be arranged in order to clear the ignition device belonging to a forward warhead out of the way. The design is characterized in that a clearing charge is linked to the structure-dividing charge in order to clear the ignition member out of the way of a warhead situated to the rear. In one design, the clearing charge is made up of a curved plate arranged between the ignition device and the supporting structure to cover only parts of the circumference of the ignition device.

The clearing charge is preferably ignited by crossover ignition from the structure-dividing charge. In this case, the structure-dividing charge and the clearing charge can advantageously be designed as one component.

In a simple and operationally reliable design, the initiation of the front warhead, the structure-dividing charge and the clearing charge is effected by means of the ignition device acting at one initiation point common to the warhead and the two charges.

BRIEF DESCRIPTION OF THE DRAWINGS

The invention will be described in greater detail below with reference to the attached drawings, in which.

DETAILED DESCRIPTION OF THE PREFERRED EMBODIMENT(S)

Figure 1:
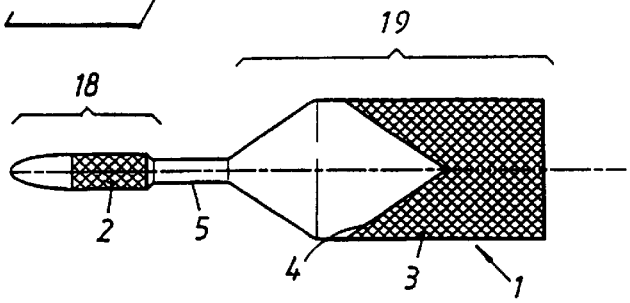
FIG. 1 shows diagrammatically an example of an ammunition unit according to the invention in the form of a tandem shell.

The ammunition unit shown in FIG. 1 is in the form of a shell 1 and comprises a front explosive charge 2, which is incorporated in a front warhead 18, and a rear explosive charge 3, which is incorporated in a rear warhead 19. In the embodiment shown here, the rear explosive charge 3 includes a shaped charge with liner 4, while the front charge includes another type of charge known in connection with tandem shells. However, there is nothing to prevent both charges from being of the shaped-charge type. The front and rear charges 2, 3 are held together by means of a supporting structure 5 in the middle part of the shell.

Figure 2A:
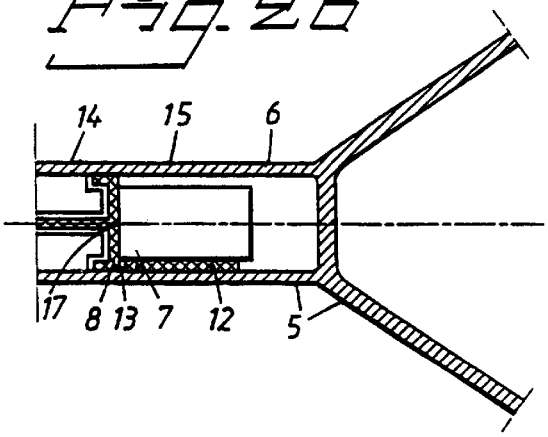
FIGS. 2*a* to 2*c* show diagrammatically a section through the middle part of the tandem shell according to FIG. 1, at three different times during the shell's detonation phase.

FIG. 2 shows the middle part 5 of the shell in greater detail. The supporting structure 5 comprises a tubular part 6 which accommodates, among other things, the ignition device 7 of the front explosive charge, with ignition members and safety members. In this regards, it is worth noting that a corresponding ignition device, not shown, is arranged behind the rear explosive charge 3.

Figure 3A:
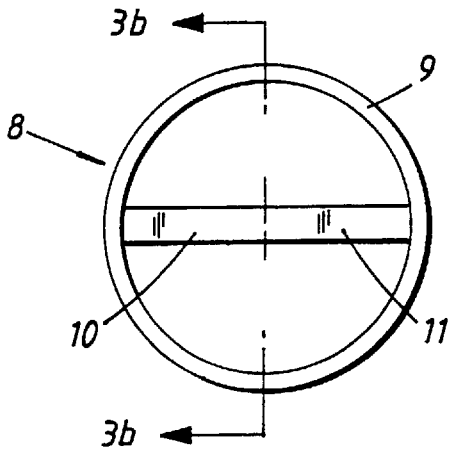
FIGS. 3*a* and 3*b* show, in a front view and cross-sectional side view, respectively, a first example of a structure-dividing charge which can be incorporated in the tandem shell according to FIG. 1.
Figure 3B:
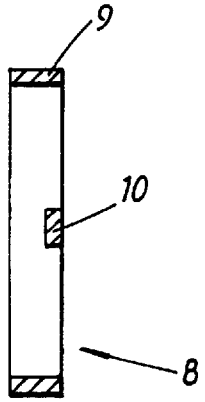

Arranged between the ignition device and the front explosive charge there is a structure-dividing charge 8. A first example of a structure-dividing charge is shown in FIGS. 3*a* and 3*b*. The structure-dividing charge 8 in this case comprises a ring 9 and two radially opposed channels 10, 11 which connect to the center of the ring. The external diameter of the ring is dimensioned so as to correspond essentially to the internal diameter of the tubular structure 5.

Figure 4A:
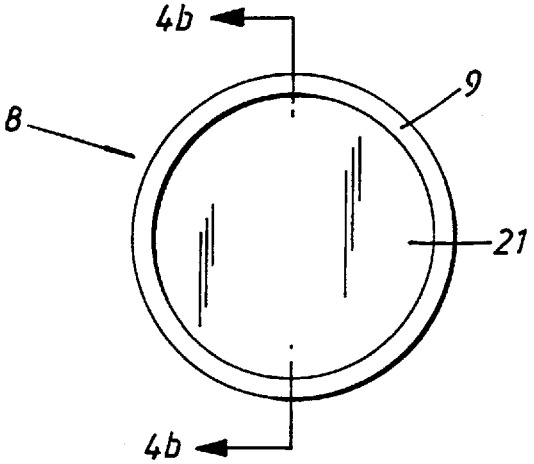
FIGS. 4*a* and 4*b* show, in a front view and cross-sectional side view, respectively, a second example of a structure-dividing charge which can be incorporated in a tandem shell according to FIG. 1.
Figure 4B:
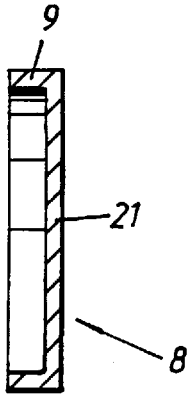

According to a second embodiment of a structure-dividing charge, shown in FIGS. 4*a* and 4*b*, the structure-dividing charge 8 comprises a ring 9 and a disc 21. The ring 9 and the disc 21 can be designed as one unit. As in the design described above with reference to FIGS. 3*a* and 3*b*, the external diameter of the ring is dimensioned to correspond essentially to the internal diameter of the tubular structure 5.

Figure 5:
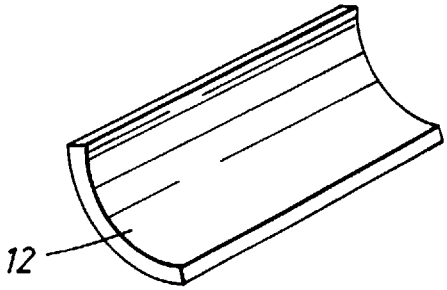
FIG. 5 shows a perspective view of an example of a clearing charge which can be incorporated in the tandem shell according to FIG. 1.

Arranged in the space between the ignition device 7 and the tubular structure 5, there is a clearing charge 12. In the design shown here, the clearing charge has the shape of a curved plate, see in particular FIG. 5, which plate covers parts of the circumference of the ignition device. The clearing charge 12 is separated from the structure-dividing charge 8 by means of an air gap 13 which is dimensioned so that crossover ignition of the clearing charge can be effected from the structure-dividing charge. Alternatively, the clearing charge 12 and the structure-dividing charge 8 can be arranged in direct connection to each other or can even be designed as one single-piece component. A suitable material for the clearing charge and the structure-dividing charge is a compressible explosive, for example of the plastic-based type.

A number of alternative positions are possible for the clearing charge 12. For example, according to one embodiment, the clearing charge 12 can be arranged in the ignition device 7 and, according to another embodiment, on the outside of the structure 5.

The ignition members in the ignition device 7 act at one initiation point 17, common to the front explosive charge 2, the structure-dividing charge 8 and the clearing charge 12, at the center of the ring 9, which is included in the structure-dividing charge 8.

Figure 2B:
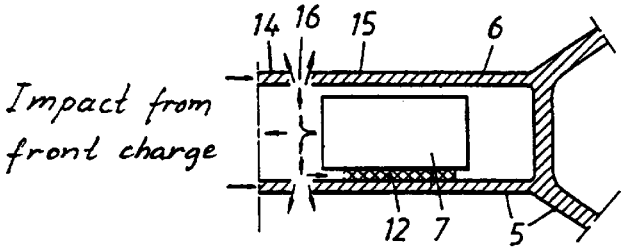
Figure 2C:
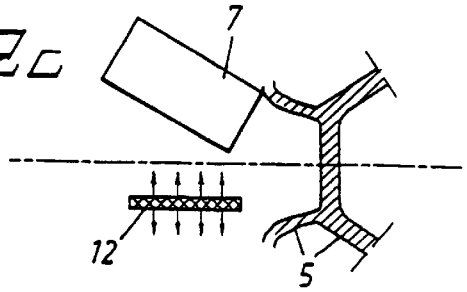

Upon initiation from the ignition device 7, the sequence of events which is shown in FIGS. 2*b* and 2*c* takes place.

In a first stage, the structure-dividing charge 8 detonates and divides the structure 5 into a front part 14 and a rear part 15 separated by an intermediate air space 16. The intermediate air space 16 can be obtained by means of comparatively large or small parts of the structure being blasted away in the vicinity of the structure-dividing charge 8. The structure-dividing charge can also effect a certain separation in the longitudinal direction between the front and rear parts of the structure.

The front charge 2 detonates slightly later. By virtue of the intermediate air space 16 which has been formed, the impact from the front charge 2 is prevented from reaching the charge 3 lying to the rear. When the structure-dividing charge 8 detonates, crossover ignition to the clearing charge 12 takes place with a certain delay. Upon detonation of the clearing charge, the rear part of the tubular structure is broken open, as indicated in FIG. 2*c*, and the ignition device 7 is caused to leave the area in front of the remaining explosive charge 3. Free space is in this way made available to allow the remaining explosive charge to develop its shaped-charge jet without disruption.

During the sequence of events described above, the clearing charge 12 can be used to transmit a detonation which in turn can ignite, for example, a charge situated to the rear.

We claim:

1. Ammunition unit in the form of a shell, comprising at least one front warhead and one rear warhead arranged in succession one after the other and connected to each other via a supporiting structure, an ignition device with ignition and safety functions for each of the warheads, the ignition device of the front warhead being arranged in the supporting structure behind the front warhead in a direction of action of the rear warhead, and a structure-dividing change arranged in the supporting structure to divide the supporting structure into a front part and a rear part in response to the initiation of the ignition device of the front warhead and before activation of the at least one fron warhead and the one rear warhead.

2. Ammunition unit according to claim 1, wherein said structure-dividing charge comprises a disc-shaped element whose external diameter essentially corresponds to an internal diameter of the supproting structure.

3. Ammunition unit according to claim 1, wherein said structure-dividing charge comprises an annular element with an external diameter essentially corresponding to an internal diameter of the supporting structure, and wherein a number of radial channels connect the inner surface of the annular element to a center point common to the channels.

4. Ammunition unit according to claim 3, wherein the annular element is connected to the common center point by means of two channels directed radially towards each other.

5. Ammunition unit according to claim 1, wherein a clearing charge is linked to the structure-dividing charge to clear the ignition device of the front warhead out of the way of the rear warhead.

6. Ammunition unit according to claim 5, wherein the clearing charge comprises a curved plate arranged between the ignition device of the front warhead and the supporting structure and covers only parts of a circumference of the ignition device of the front warhead.

7. Ammunition unit according to claim 5, wherein the structure-dividing charge and the clearing charge are designed as one component.

8. Ammunition unit according to claim 5, wherein the structure-dividing charge, the clearing charge, and the front warhead are provided with one detonation point common to the ignition device.

* * * * *